US005452834A

United States Patent [19]

Mariotti et al.

[11] Patent Number: 5,452,834

[45] Date of Patent: Sep. 26, 1995

[54] WEB TURNING BAR WITH SELECTIVELY ACTIVATED AIR FLOW PORTS

[75] Inventors: Jean Mariotti, Monchy-St-Eloi; Cherif Elkotbi, Compiegne, both of France

[73] Assignee: Heidelberger Druckmaschinen AG, Heidelberg, Germany

[21] Appl. No.: 143,001

[22] Filed: Oct. 25, 1993

[30] Foreign Application Priority Data

Oct. 26, 1992 [FR] France ..... 92 12707

[51] Int. Cl.[6] ..... B65H 23/32

[52] U.S. Cl. ..... 226/197; 226/199; 251/335.2

[58] Field of Search ..... 226/197, 198, 226/199; 101/228; 251/331, 319, 335.2, 61.1; 137/625.28

[56] References Cited

U.S. PATENT DOCUMENTS

| | | | |
|---|---|---|---|
| 2,598,207 | 5/1952 | Bailey et al. | 251/61.1 |
| 3,690,344 | 9/1972 | Brumm | 251/61.1 |
| 4,453,465 | 6/1984 | Heller et al. | 226/197 |

FOREIGN PATENT DOCUMENTS

| | | | |
|---|---|---|---|
| 0092658 | 11/1983 | European Pat. Off. | B41F/13/06 |

*Primary Examiner*—Daniel P. Stodola

*Assistant Examiner*—Thomas E. Dunn

*Attorney, Agent, or Firm*—Kenyon & Kenyon

[57] ABSTRACT

A turning bar for changing the direction of a running web or ribbon of paper exiting a printing press. The turning bar is defined by an axisymmetric cylindrical wall having two half surfaces, one half surface having air blow-holes distributed therealong. The turning bar includes a device for blocking the air blow-holes which includes a plurality of flexible membranes and a corresponding plurality of maneuvering handles. The flexible membranes have the shape of an axisymmetric cylindrical sleeve and are arranged inside the turning bar and distributed one after the other over the entire length of the turning bar. The maneuvering handles are arranged on the cylindrical half-surface opposite the blow holes of the turning bar, each maneuvering handle having one end disposed inside the axisymmetric cylindrical wall of the turning bar which is securely fastened to a flexible membrane allowing each flexible membrane to occupy two positions. One position is a blocking position in which the flexible membrane covers the entire cylindrical internal surface of the turning bar in a sealed fashion so as to block all the blow holes which are in the region of the membrane. The other position is a freeing position in which the flexible membrane is retracted and flattened against the cylindrical internal half-surface opposite the half surface having the blow holes so as to free the blow holes.

8 Claims, 4 Drawing Sheets

WEB TURNING BAR WITH SELECTIVELY ACTIVATED AIR FLOW PORTS

FIELD OF THE INVENTION

The present invention relates in general to turning bars which alter the direction of travel of running webs or ribbons of paper in a printing press, and more particularly to a device for blocking air blow-holes pierced in the cylindrical wall of such turning bars.

BACKGROUND OF THE INVENTION

In known web printing presses, the web or webs of paper, after having been printed, may each be split into two or more ribbons by one or more longitudinal cutting devices. The ribbons thus cut may be superimposed with or without turning, and in a modifiable order with the aid of a device called a "reel of bars". Certain designs of reel of bars also allow finished webs or ribbons to be redirected in their run-off direction or allow their run-off axis to be offset.

A reel of bars comprises several turning bars or sets of turning bars. These bars are axisymmetric and cylindrical, and generally have a diameter varying between approximately 60 and 120 millimeters, and a length varying between 800 and 2200 millimeters. The turning bars are generally positioned horizontally, their longitudinal axis of symmetry making an angle of 45° with the run-off direction of the paper upstream of the reel of bars. Thus, when a web or ribbon of paper arrives horizontally above a turning bar, tangential to its upper generatrix, the web or ribbon is partially wound around the turning bar and leaves it, tangential to its lower generatrix, still running off in a horizontal plane but now in a direction which is offset by 90° with respect to its entrance direction.

In order to avoid any offset soiling on the web, which winds around the turning bar, an air cushion must be established between the bar and the web so that the web travels over the turning bar without touching it. For this purpose, a turning bar of the known type is a hollow bar which comprises a plurality of small holes called "blow holes" passing through the wall of the bar. These blow holes are distributed along several generatrices of the turning bar. The turning bar is supplied with pressurized air from an air propeller such as a blower or a centrifugal fan. The air supplied to the inside of the turning bar is expelled through the blow holes, which makes it possible to create an air cushion between the turning bar and the web.

It should be emphasized that since a web of paper has a variable width, and may or may not be cut into several longitudinal ribbons having variable widths, it does not cover all the blow holes and leaves a certain number of blow holes unused and uncovered and these are holes through which the air escapes, which reduces the pressure of the air cushion. The number of unused hole varies as a function of the width of the web or ribbon.

It is therefore necessary, when the web or ribbon passes through the turning bars, to plug the unused blow holes so as not to decrease the pressure of the air cushion.

A solution to this problem is to stick adhesive tape around the turning bar in the region of the unused holes for a specified width of ribbon, then to remove it or add some more when the width of the ribbon is increased or decreased.

Another known solution, described in EP 0 092 658, is to install, inside the turning bar, a plurality of liners, pierced with holes, which constitute rigid sleeves whose diameters are slightly less than the internal diameter of the turning bar. These liners can be moved translationally inside the turning bar, so as to occupy two positions. In the first position the holes of the liners coincide with the blow holes of the turning bar to allow the air to escape to the outside. In the second position the holes of the liners do not coincide with the blow holes so that the liners block the blow holes.

A drawback of this solution is that the translational displacement of the liners is not always precise which may lead to the unintentional blocking or freeing of certain blow holes and thus disturb the air cushion between the turning bar and the web or ribbon of paper.

OBJECTS AND SUMMARY OF THE INVENTION

An object of the present invention is to provide an air cushion between the turning bar and the web or ribbon of paper that precisely corresponds to the width of the web or ribbon of paper travelling over the turning bar.

The present invention provides a turning bar for changing the direction of a web of paper exiting a printing press, comprising an axisymmetric cylindrical wall having two half surfaces, one half surface having air blow-holes distributed therealong, and means for blocking the air blow-holes. The blocking means comprises a plurality of flexible membranes each having the shape of an axisymmetric cylindrical sleeve, arranged inside the turning bar and distributed one after the other over the entire length of the turning bar. The blocking means further comprises a plurality of maneuvering handles mounted for sealed sliding in the axisymmetric cylindrical wall of the turning bar substantially perpendicularly to the external and internal surfaces of the turning bar, and arranged on the cylindrical half-surface opposite the blow holes of the turning bar, each maneuvering handle having one end disposed inside the axisymmetric cylindrical wall of the turning bar which is securely fastened to a flexible membrane allowing each flexible membrane to occupy two positions. The first position is a blocking position in which the flexible membrane covers the entire cylindrical internal surface of the turning bar in a sealed fashion so as to block all the blow holes which are in the region of the membrane. The second position is a freeing position in which the flexible membrane is retracted towards the cylindrical half-surface opposite the half surface having the blow holes so as to free the blow holes.

Thus, according to the present invention, by individually actuating each of the maneuvering handles, it is easy to block or to free the air blow-holes provided in the wall of the turning bar. Each flexible membrane in the first blocking position perfectly matches the internal surface of the turning bar so as to block the blow holes arranged in its vicinity. In the freeing position each membrane is retracted over the internal surface opposite the surface carrying the blow holes so as to free the latter. There is hence no risk, when each of the membranes is put into the first or the second position, of any untoward blocking or freeing of the blow holes, i.e., only those holes which correspond exactly to the width of the web or ribbon of running paper are freed to create an air cushion between the web or ribbon of paper and the turning bar. The actuation of each of the maneuvering handles may be manual or remotely controlled by micro-jacks adjusted to the width of the web of paper running off over the turning bar.

Other objects, characteristics and advantages of the present invention will become apparent in view of the detailed description and drawings that follow.

DETAILED DESCRIPTION

Figure 1:
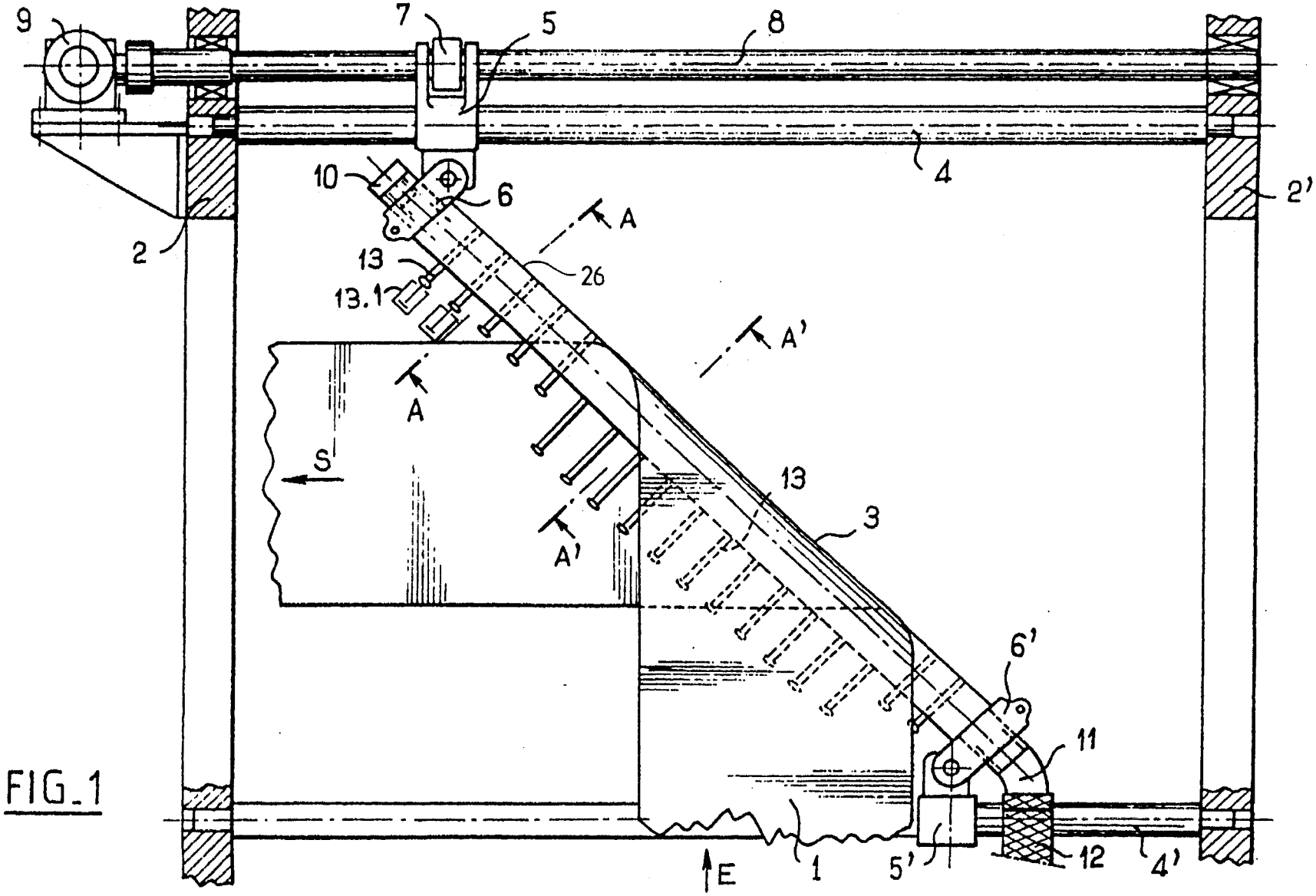
FIG. 1 is a top view of the turning bar according to the present invention.

Referring to FIG. 1, a reel of bars device is shown comprising a turning bar 3, which is able to modify the run-off direction of a web of paper 1, which is partially wound around the turning bar. The turning bar 3 is positioned in the horizontal run-off plane of the web of paper 1, its longitudinal axis of symmetry making an angle of 45° with the run-off direction E of the web of paper upstream of the reel of bar. More particularly, the turning bar 3 is fixed at each of its ends to frames 2, 2' of a rotary printing press (not shown) by means of flanges 5, 5' which are mounted slidably on two cylindrical guides 4, 4' perpendicular to the run-off direction E of the web of paper 1 upstream of the reel of bars.

The turning bar 3 is fixed to the flanges 5, 5' by collars 6, 6'. The guides 4, 4' are mounted horizontally between the frames 2, 2'. The movable flange 5 is translationally driven by a nut 7 rotationally immobilized on a screw 8 which is rotationally driven by a motor 9. The movable flange 5 is mounted to translate freely on the guide 4. A plug 10 is screwed on the end of the turning bar 3 adjacent the flange 5. An elbow 11 is securely fastened to the end of the turning bar 3 adjacent flange 5' which is free to slide on the bar 4'. A rubber hose 12 is force-fitted over the elbow 11 which is connected to an air propeller (not shown). The air propeller may, for example, be a blower or a centrifugal fan and is used for blowing air into the turning bar 3 under a pressure of at least 0.2 bar.

Figure 4B:
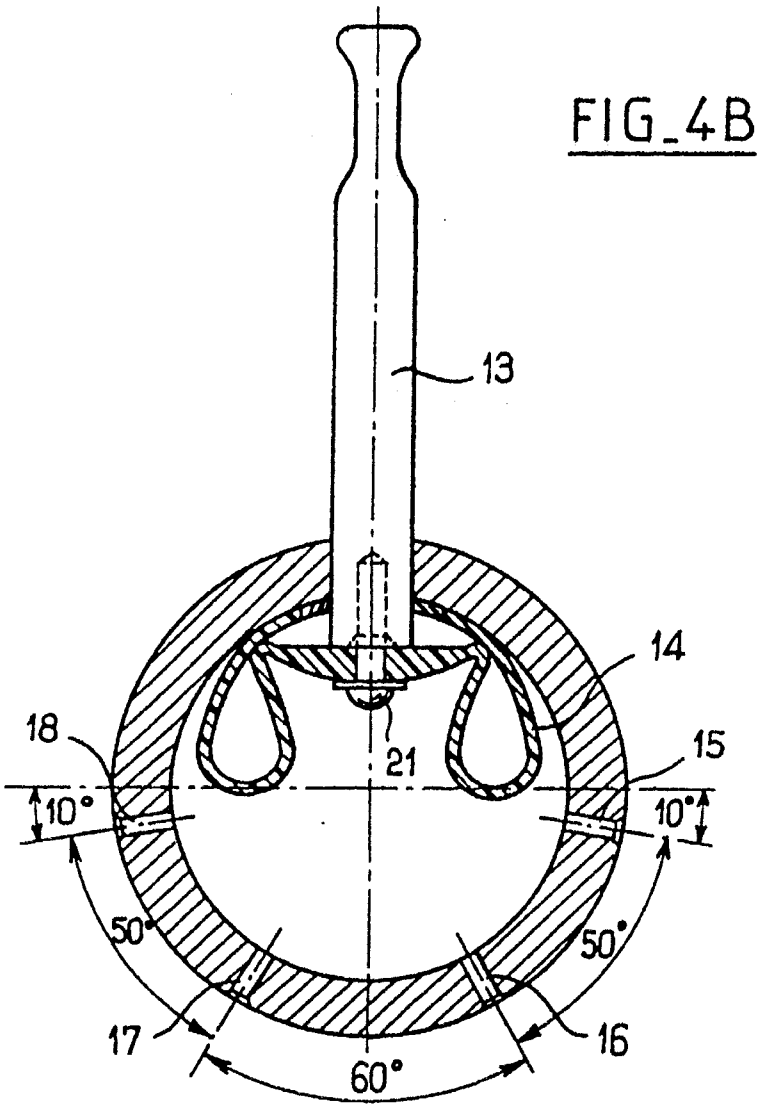
FIG. 4B is a sectional view along the plane A'—A' of the turning bar of FIG. 1.
Figure 4A:
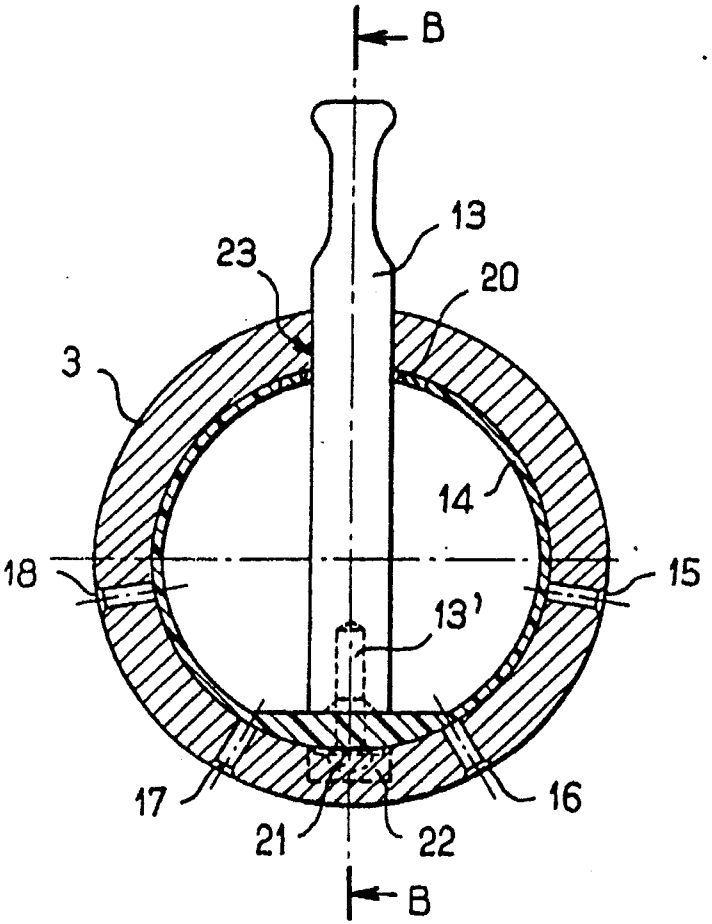
FIG. 4A is a sectional view along the plane A—A of the turning bar of FIG. 1.
Figure 5:
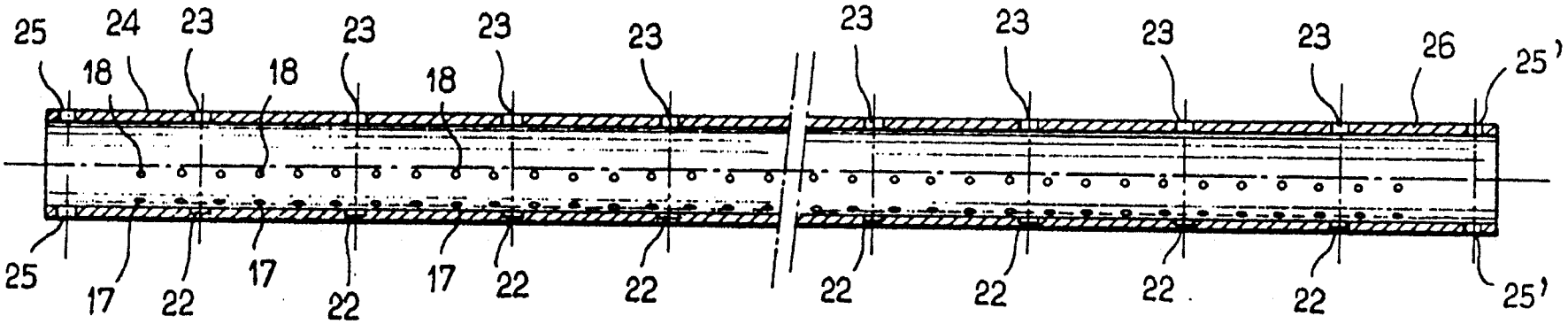
FIG. 5 is a longitudinal sectional view of the turning bar according to the present invention.

As is best shown in FIGS. 4A, 4B and 5, the turning bar 3 is constructed out of a hollow steel tube having an axisymmetric cylindrical wall whose external surface is covered, for example, by an electrolytic deposit of chrome 24 and whose internal surface finish and the tolerance on the internal diameter are of very high quality. The cylindrical wall of the turning bar 3 is pierced with a multitude of small holes 15, 16, 17, 18 whose diameter is approximately equal to 4 millimeters. These holes are called air blow-holes because they make it possible to expel the air sent into the turning bar by the air propeller so as to form an air cushion between the web of paper 1 running off and the turning bar so as to avoid any offset soiling on the web of paper. These air blow-holes 15, 16, 17, 18 are distributed along four generatrices of the turning bar 3 placed on a cylindrical half-surface of the latter. The blow holes 15, 16, 17, 18 have a cylindrical shape through the wall of the turning bar 3, and the axes of the blow holes are oriented perpendicularly to the external surface of the turning bar along its generatrices.

In particular, as is best shown in FIGS. 4A and 4B, a first group of blow holes 15 is distributed over a first generatrix situated 10° below a first median generatrix of the turning bar. The first median generatrix represents the upper line of contact between the arriving web of paper 1 and the turning bar 3. A second set of blow holes 16 is distributed over a second generatrix situated on the cylindrical surface of the turning bar 3 approximately 50° away from the first generatrix in the clockwise direction of rotation. In the same manner, a third set of blow holes 17 is distributed along a third generatrix situated approximately 60° away from the second generatrix in the clockwise direction. Finally, a fourth set of blow holes 18 is distributed along a fourth generatrix situated approximately 50° away from the third generatrix in the clockwise direction of rotation or approximately 10° away from the second median generatrix in a counterclockwise direction of rotation. The second median generatrix is situated on the surface of the turning bar 3 in a symmetrically opposite manner, with respect to the axis of the turning bar, to the first median generatrix and constitutes the lower line of contact between the leaving web of paper 1 and the turning bar 3.

Furthermore, as can be seen in FIGS. 1–5 the turning bar 3 comprises a device for blocking the unused blow holes.

This blocking device comprises a plurality of flexible membranes 14 each having the shape of an axisymmetric cylindrical sleeve, arranged inside the turning bar 3 and distributed one after the other over the entire length of the turning bar 3. More particularly, these membranes are made, for example, from neoprene and are approximately 5 millimeters away from one another inside the turning bar 3.

Additionally, the blocking device comprises a plurality of maneuvering handles 13 mounted for sealed sliding in the wall of the turning bar 3 substantially perpendicularly to the external and internal surfaces of the cylindrical wall of the turning bar, and arranged along a generatrix 26 placed on the cylindrical half-surface of the turning bar 3 opposite the half-surface carrying the blow holes 15, 16, 17, 18. In a typical arrangement shown in FIG. 1, the turning bar 3 comprises a set of sixteen maneuvering handles 13 distributed over the entire length of the bar. Each maneuvering handle 13, which can be actuated individually from the outside, comprises one end placed inside the bar, securely fastened to a flexible membrane 14, and allows each flexible membrane 14 to be positioned in two positions. In the first position, a blocking position, shown in FIG. 4A, the flexible membrane 14 covers the entire cylindrical internal surface of the turning bar 3 in a sealed fashion so as to block all the blow holes 15, 16, 17, 18 which are in the region of the membrane. In the second position, a freeing position, shown in FIG. 4B, the flexible membrane 14 is retracted against the cylindrical internal half-surface opposite the half-surface comprising the blow holes 15, 16, 17, 18 so as to free the blow holes.

Figure 2:
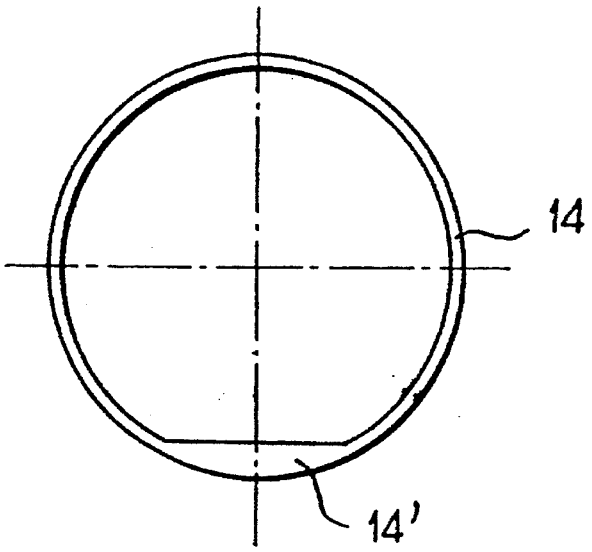
FIG. 2 is a flexible membrane which forms part of a blocking device of the turning bar of FIG. 1.
Figure 3:
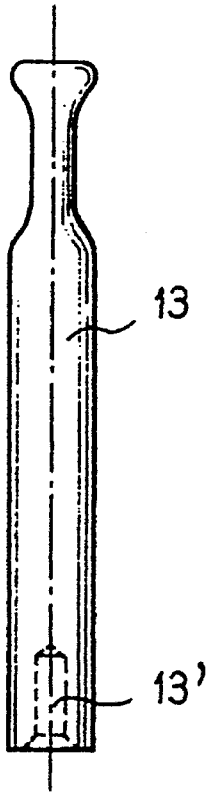
FIG. 3 is a maneuvering handle which forms part of the blocking device of the turning bar of FIG. 1.

Each flexible membrane 14 has the shape of an axisymmetric cylindrical sleeve whose thickness is approximately 2 millimeters and length is approximately 100 millimeters. Each flexible member 14 also comprises an internally flared part 14' (as shown in FIG. 2) so as to form an internal flat portion whose length is approximately 30 millimeters and a circular passage hole 20 (as shown in FIG. 4A) whose diameter is 20 millimeters, placed opposite the internally flared part 14' and allowing the sealed passage of a maneuvering handle 13 once the flexible membrane is positioned inside the turning bar 3, as shown in FIGS. 2 and 4A. Thus, each maneuvering handle 13 passes through the wall of the flexible membrane 14 and is fixed on the internal side of each flexible membrane 14 to the internally flared part 14'.

Each maneuvering handle 13 has an overall axisymmetric cylindrical shape with an upper part placed outside the turning bar 3 narrowing in cross-section. Each maneuvering handle 13 further comprises a cylindrical bore 13', disposed at the end placed inside the turning bar 3, allowing the passage of a fastening rivet 21 introduced from outside the flexible membrane 14 towards the inside of the membrane through the inner internally flared part 14' (as shown in FIGS. 4A & 4B) and, once the membrane is placed inside the turning bar 3, engaging in the cylindrical bore 13' when the maneuvering handle is put in place in the turning bar.

Once the flexible membrane 14 is fixed to the maneuvering handle 13 the rivet head 21 projects outside the flexible membrane 14. Counter-indentations 22 are provided in the turning bar 3 to house the heads of the rivets 21 when, as shown in FIG. 4A, the flexible membranes 14 are in the blocking position inside the turning bar.

It should be emphasized that each maneuvering handle 13 is mounted for sealed sliding in a passage hole 23 placed on the generatrix 26 of the turning bar 3.

Thus, when the web of paper 1 arrives horizontally above the turning bar 3 tangential to its upper line of contact, as shown in FIG. 1, it is wound around the turning bar over an angle of approximately 180° and leaves it tangential to its lower line of contact along a direction which makes an angle of 90° with its entrance direction. Since the web of paper 1 has a certain width it does not use all the air blow-holes provided on the turning bar 3. In order to block the unused air blow-holes, an operator may manually press on the maneuvering handles 13 corresponding to the unused holes, to push them inside the turning bar 3 thereby leading to the positioning of the flexible membranes 14 connected to these handles, which stick against the internal wall of the turning bar 3. Air cannot thus leave in the region of those membranes and the sealing of the turning bar 3 is ensured by the air pressure prevailing inside the turning bar, which pressure flattens the membrane against the internal surface of the turning bar. In contrast, in order to free the used blow holes which contribute to forming the air cushion between the web of paper 1 and the turning bar 3, the operator pulls the maneuvering handles 13 outwards, which allows the flexible membranes 14, connected to the maneuvering handles, to be flattened against the internal surface of the bar opposite that surface which carries the blow holes. The blow holes 15, 16, 17 and 18 are thus freed and air may escape so as to create the anti-offset soiling air cushion between the turning bar 3 and the web of paper 1.

The present invention is in no way limited to the embodiment described and shown herein. For example, one modification is contemplated wherein each maneuvering handle 13, which can be individually actuated, is remotely controlled by means of pneumatic microjacks 13.1 adjusted to the width of the web of paper 1. Other modifications and/or alterations which are within the contemplation of a person of ordinary skill in the art are encompassed by the present invention as covered by the claims.

What is claimed is:

1. A turning bar for changing the direction of a web of paper exiting a printing press comprising:

(a) an axisymmetric cylindrical wall having two half surfaces, one half surface having air blow-holes distributed therealong; and (b) means for blocking the air blow-holes comprising:

(i) a plurality of flexible membranes each having the shape of an axisymmetric cylindrical sleeve, arranged inside the turning bar and distributed one after the other over the entire length of the turning bar; and (ii) a plurality of maneuvering handles mounted for sealed sliding in the axisymmetric cylindrical wall of the turning bar substantially perpendicularly to the external and internal surfaces of the turning bar, and arranged on the cylindrical half-surface opposite the blow holes of the turning bar, each maneuvering handle having one end disposed inside the axisymmetric cylindrical wall of the turning bar which is securely fastened to a respective flexible membrane allowing each flexible membrane to occupy two positions:

a first blocking position in which the flexible membrane covers the entire cylindrical internal surface of the turning bar in a sealed fashion so as to block all the blow holes which are in the region of the membrane, and a second freeing position in which the flexible membrane is retracted against the cylindrical internal half-surface opposite the half surface having the blow holes so as to free the blow holes.

2. The turning device according to claim 1, wherein each flexible membrane having the shape of an axisymmetrical cylindrical sleeve further includes:

an internally flared part which forms an internal flat portion and a passage hole disposed opposite the flat portion, a respective one of the maneuvering handles fixed to the internal flat portion and extending through the passage hole.

3. The turning bar according to claim 2, wherein each maneuvering handle comprises at its end fixed to each flexible membrane a bore allowing the passage of a fastening rivet having a head introduced from outside the flexible membrane towards the inside of the flexible membrane through the internal flat portion so that the head of the rivet projects outside the flexible portion of the flat membrane.

4. The turning bar according to claim 3, wherein the turning bar comprises, on the internal surface of its cylindrical wall, counter-indentations which house the heads of the fastening rivets when the flexible membranes are in the blocking position inside the turning bar.

5. The turning bar according to claim 2, wherein each flexible membrane has a thickness of approximately 2 millimeters, a length of approximately 100 millimeters and a flat portion whose length is approximately 30 millimeters.

6. The turning bar according to claim 2, further comprising pneumatic micro-jacks which can be controlled to individually adjust the maneuvering handles so that all the blow holes along the width of the web of paper are free to create an air cushion so that the web of paper does not touch the turning bar as it travels over the turning bar.

7. The turning device according to claim 2, wherein each passage hole provides a sealed passage for movement of its respective maneuvering handle.

8. The turning bar according to claim 1, wherein the flexible membranes disposed inside the turning bar are approximately 5 millimeters away from one another.

* * * * *